United States Patent [19]

Steimel et al.

[11] Patent Number: 4,470,744

[45] Date of Patent: Sep. 11, 1984

[54] APPARATUS FOR TAKING HOLD OF, LIFTING TRANSPORTING AND PUTTING DOWN CENTRIFUGE DRUMS

[76] Inventors: Richard Steimel, Frankfurter Strasse 134; Werner Holpp, Bergstrasse 29, both of 5202 Hennef, Fed. Rep. of Germany

[21] Appl. No.: 324,393

[22] PCT Filed: Mar. 20, 1981

[86] PCT No.: PCT/DE81/00048

§ 371 Date: Nov. 16, 1981

§ 102(e) Date: Nov. 16, 1981

[87] PCT Pub. No.: WO81/02692

PCT Pub. Date: Oct. 1, 1981

[30] Foreign Application Priority Data

Mar. 21, 1980 [DE] Fed. Rep. of Germany ..... 3010960

[51] Int. Cl.[3] ..... B04B 11/04

[52] U.S. Cl. ..... 414/420; 294/90

[58] Field of Search ..... 414/419, 420, 422; 294/86 R, 90

[56] References Cited

U.S. PATENT DOCUMENTS 3,438,510 4/1969 Fawell ..... 294/86 R 3,670,912 6/1972 Dunbar ..... 414/420

FOREIGN PATENT DOCUMENTS 2030591 1/1972 Fed. Rep. of Germany .

*Primary Examiner*—Robert G. Sheridan

*Attorney, Agent, or Firm*—Michael J. Striker

[57] ABSTRACT

An apparatus for taking hold of, lifting, transporting and putting down centrifuge drums of mechanically loaded and unloaded centrifuges for clearing oil and water therefrom, and washing, drying and other processing of pieces of material in industry, includes a traveling hoist able to be moved between at least two stations and supporting a lifting and lowering system, on whose end, which can be run out into a working position, there is a gripper for gripping such a centrifuge drum near its top edge. For quickly and safely taking hold of lifting, transporting and putting down centrifuge drums of mechanically loaded and unloaded centrifuges the apparatus is provided with a frame, joined up with the traveling hoist, and two gripping shoes, which are placed opposite to each other and able to be moved radially in relation to the drum so as to be partly round it, the shoes being bearinged in the frame so that they may be turned about a horizontal axis, at least one of the shoes having a driving system for turning it.

8 Claims, 5 Drawing Figures

APPARATUS FOR TAKING HOLD OF, LIFTING TRANSPORTING AND PUTTING DOWN CENTRIFUGE DRUMS

BACKGROUND OF THE INVENTION

The present invention relates to an apparatus for taking hold of, lifting, transporting and putting down centrifuge drums of mechanically loaded and unloaded centrifuges for clearing oil and water therefrom, and washing, drying and other processing of pieces of material in industry, having a traveling hoist, able to be moved between at least two stations and supporting a lifting and lowering system, on whose end, which can be run out into a working position, there is a gripper for gripping such a centrifuge drum near its top edge.

An apparatus on these lines is known in the prior art, see German Offenlegungsschrift specification No. 2,030,591.

In the known apparatus for processing pieces of material in industry a centrifuge, whose centrifuge drum may be lifted out of position, has a loading station and an unloading station. In the loading station the centrifuge drum is loaded with the material to be processed, whereas in the unloading station the centrifuge drum, full of the processed material, is placed on a tipping system in which the centrifuge drum may be turned, for example through 180°, so that the processed material may be put in a box. The apparatus for taking hold of, lifting and transporting the centrifuge drum, for this reason takes up a drum full of the material to be processed, puts it down in the centrifuge, then takes up the unloaded centrifuge drum in the unloading station and puts it into the loading station, so that when its turn comes it may take up the drum processed in the centrifuge and put it down in the unloading station.

The apparatus of this earlier invention has the shortcoming however that the unloading of the centrifuge drum is only possible in the tipping unit in the unloading station. In the trade however it is frequently best for the centrifuge drums, full of processed material, to be unloaded at different positions, and for example unloading at different, desired positions may be necessary and different sorts of pieces of material are processed in the trade or pieces of material of one single sort are to be differently processed.

SUMMARY OF THE INVENTION

One object of the invention is that of overcoming the shortcomings of the known apparatus and that of designing an apparatus which makes it possible for centrifuge drums to be unloaded at any desired points on a transport path.

Taking as a starting point an apparatus of the sort noted, for effecting this purpose in a frame, joined up with the traveling hoist, there are two gripping shoes, which are placed opposite to each other and able to be moved radially in relation to the drum so as to be partly round it, the shoes being bearinged in the frame so that they may be turned about an horizontal axis, at least one of the shoes having a driving system for turning it.

Using the apparatus of the present invention it is now possible not only for one centrifuge drum to be taken hold of, or put down, in the separate stations of a processing plant, but it is furthermore possible for it to be tilted at any desired stations so that the centrifuge drum may be unloaded at different points. With the help of the apparatus of the present invention it is however furthermore possible for the centrifuge drums to have the load in them changed or however, furthermore, if there are trouble conditions because a load is out of balance, for the material to be changed in position within the drums.

It is best for the centrifuge drum to have at least one outwardly running gripping ring round it and the gripping shoes may have a narrow opening for taking up the gripping ring. If the centrifuge drum taken hold of by the gripping apparatus, is lifted by the lifting and lowering unit into a given position, the gripping shoes may be moved radially in relation to the drum so that the gripping shoes are placed around a part of the gripping ring so that the centrifuge drum is tightly gripped. The gripping unit on the lifting and lowering unit may then be opened so that, by turning one gripping shoe the centrifuge drum may be tipped.

Further details of the invention will be seen from the claims.

An account will now be given of one working example of the invention using the figures.

DETAILED DESCRIPTION OF THE PREFERRED EMBODIMENT

Figure 1:
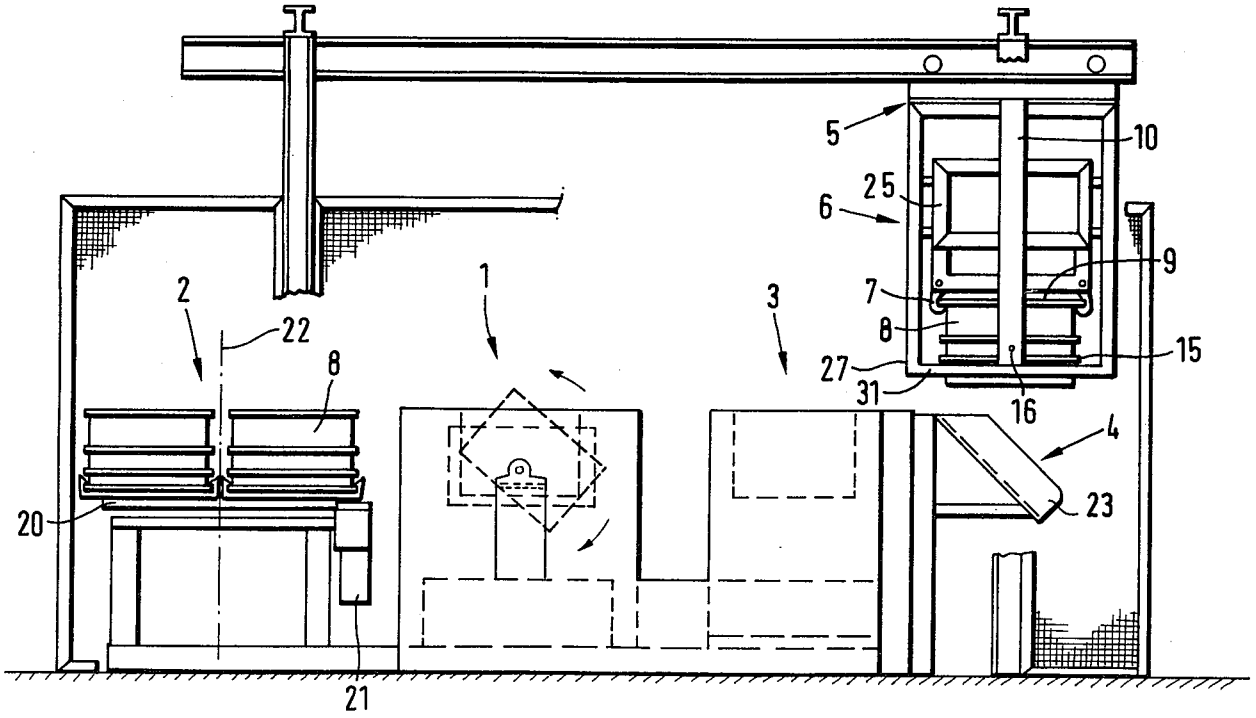
FIG. 1 is a side view of a plant for centrifuging pieces of material in industry with an apparatus of the present invention for taking hold of, lifting, transporting and putting down centrifuge drums.
Figures 2A, 2B:
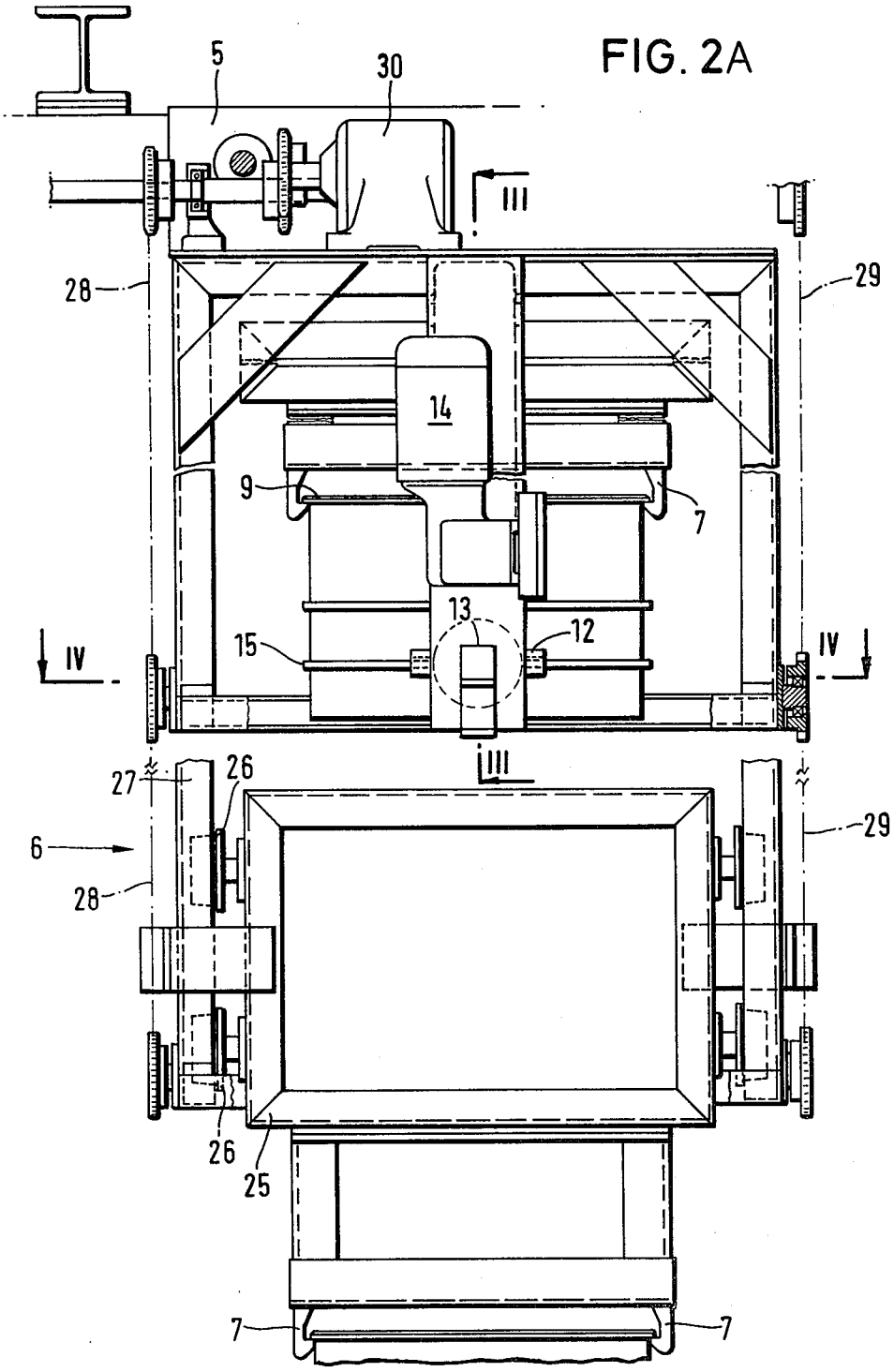
FIG. 2*a* is a side view of the apparatus of the invention with the gripping unit in the lifted position.
FIG. 2*b* is a partial side view of the apparatus of FIG. 2*a*, but with the gripping unit displaced downwardly.

FIG. 1 is a side view of a plant for processing, for example electroplating, pieces of material in industry with a centrifuge 1 which has a loading station 2 for loading the centrifuge drums 8, a further processing station 3 and an unloading station 4. For taking hold of, lifting, transporting and putting down the centrifuge drums 8 use is made of a lifting and lowering unit 6 which may be moved from point to point by way of a traveling hoist 5 running on rails, lifting and lowering unit 6 having at its lower end a gripping unit 7, with which the centrifuge drums 8 may be taken hold of at their top, outwardly turned edges 9. The lifting and lowering unit has a lifting carriage 25, guided at two opposite sides by way of two separate guide wheels 26 in upright U-rails 27 joined up with the traveling hoist 5. The gripping unit 7 has two turning hooks which may be moved into position under two opposite points of the top outwardly turned edge 9 of the centrifuge drums 8.

The loading station 2 has, for example, a turntable 20 to take up two or more centrifuge drums 8 and able to be turned by a driving system 21 about axis 22 for moving the loaded centrifuge drums 8 into a position at which they are taken hold of. The moving lifting and lowering unit 6 puts down unloaded centrifuge drums 8 on this turntable and takes up a centrifuge drum 8, loaded with pieces of material or piece goods to be processed for transporting them to a centrifuge 1 or 3, where the drum is put down. In centrifuge 1 the material to be processed may be freed of oil, and/or washed and/or drummed or tumbled and/or dried. After processing the centrifuge drum 8 may be taken from centrifuge 1 and transported to a further processing station 3 or an unloading station 4. Using unloading station 4 the centrifuge drum 8 may be turned with the help of the gripping shoes 11, 12 through 180° about the horizontal axis 16 so that the material within the drum may be run down a slide 23 to a transporting carriage or transporting belt or the like, not to be seen in the figures.

Figure 3:
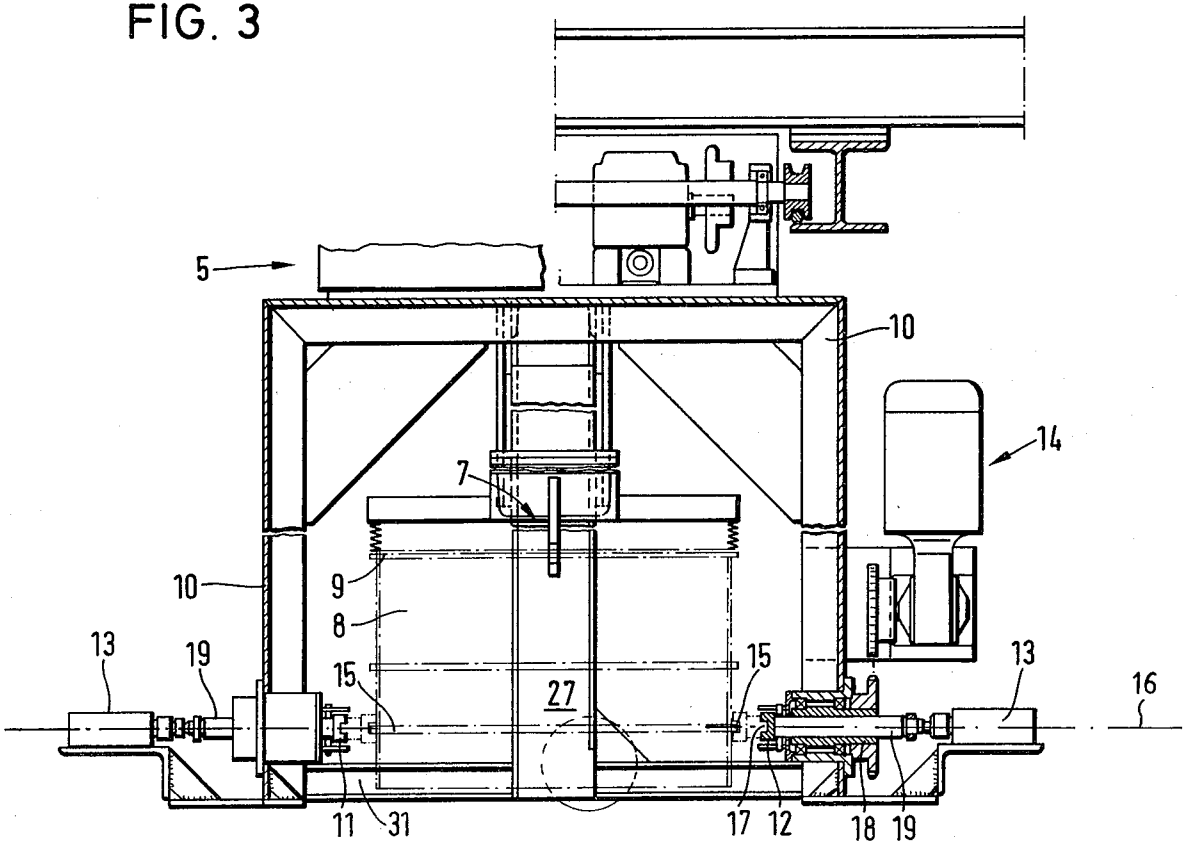
FIG. 3 is a view on the section line III—III of FIG. 2*a*.
Figure 4:
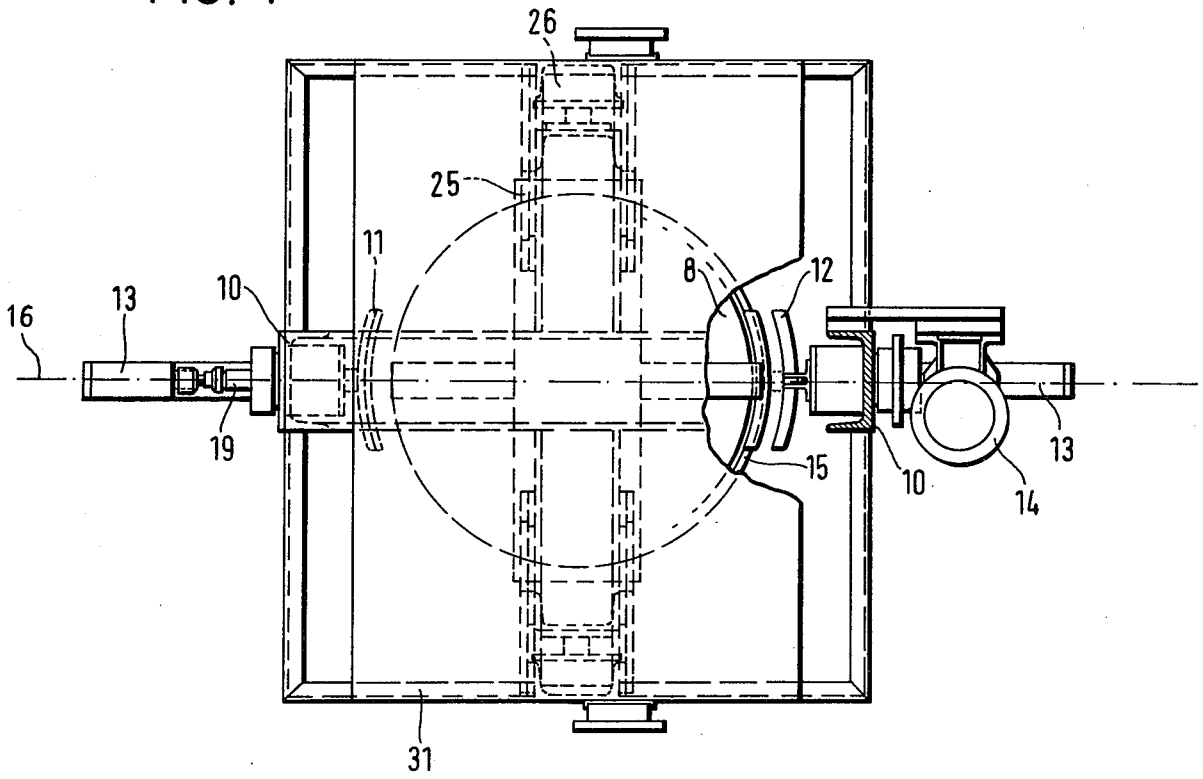
FIG. 4 is a view on the section line IV—IV of FIG. 2*a*.

As may be seen more specially from FIG. 3, the gripping shoes 11, 12 are placed in a frame 10 joined up with traveling hoist 5 and may be moved by air-powered or liquid-powered cylinders 13 radially in relation to the centrifuge drum 8. Gripping shoes 11 and 12 take up positions round the centrifuge drum 8 so that the gripper unit 7, at the lower end of the lifting and lowering unit, may be undone. In the unloading station at least one gripping shoe 12 may be turned by a driving system 14 through, for example, 180° for turning out the material in the drum. At least one gripping ring 15 is fixed round the drum 8, gripping shoes 11 and 12 having a narrow opening 17 for taking up the gripping ring 15. Gripping ring 15 and narrow opening 17 in the gripping shoes 11, 12 make certain that the centrifuge drum 8 may be safely gripped by gripping shoes 11 and 12, even if there is only a low force acting on the gripping shoes.

The driving system 14 is used for driving (by way of a driving chain) a sleeve 18 bearinged in frame 10 by way of rolling element bearings. The stem 19 of gripping shoe 12 is placed in sleeve 18 so that it may not be turned in relation to the sleeve but may be moved lengthwise.

The gripping ring 15 is best placed on a centrifuge drum 8, loaded with material to be processed, at the same level as the center of gravity. Because the height or level of the center of gravity will be dependent on the sort of material to be processed and the level of such material in the drum, it may be best for each centrifuge drum to have two or three gripping rings 15 which are spaced from each other and positioned on the lower half of the drum.

The lifting and lowering unit 6 has limit switches, sensors or the like turning on the system for moving the gripping shoes 11, 12 into position when the gripping ring 15 of centrifuge drum 8 is at the same level as the gripping shoes 11, 12. The motion of the traveling hoist 5, of the lifting and lowering unit 6, of the gripping unit and of the gripping shoes 11, 12 may be programmed for different groups of motions coming one after the other.

We claim:

1. An apparatus for holding, lifting, transporting and putting down centrifuge drums of mechanically loaded and unloaded centrifuges for clearing oil and water therefrom and washing, drying or otherwise processing pieces of material contained in the centrifuge drums, comprising a lifting and lowering unit engageable with a centrifuge drum to be processed; a traveling hoist movable between at least two stations and supporting said unit, said unit having an end facing said stations, each of said drums having a top edge; gripper means (7) for gripping the drum being processed near the top edge thereof; a frame (10) rigidly joined to the traveling hoist and carrying two gripping shoes (11, 12) which are positioned opposite to each other and adapted to be moved radially towards the drum to surround and grip the drum in addition to and at a distance from said gripper means, said frame having a horizontal axis, through which said opposite gripping shoes project, said shoes being supported in said frame so that they may be turned about said horizontal axis; and a driving system (14) operatively connected to at least one of said shoes for turning it.

2. The apparatus as defined in claim 1, wherein each centrifuge drum has at least one gripping ring fixed round the drum, said gripping shoes being each formed with a recess engageable with the gripping ring for gripping the drum.

3. The apparatus as defined in claim 2, wherein each drum has a lower part, the gripping ring being positioned at said lower part substantially at the same level as the center of gravity of a loaded drum.

4. The apparatus as defined in claim 3, further including means for moving said gripping shoes radially to and from the drum being processed and having air-powered driving cylinders (13) each connected with an associated gripping shoe.

5. The apparatus as defined in claim 4, wherein the lifting and lowering unit has a lifting carriage (25) to which said gripper means (7) is connected.

6. The apparatus as defined in claim 5, wherein said unit further includes two upright U-shaped rails (27) mounted at two opposite sides of said lifting carriage and connected to the traveling hoist, opposite guide wheels (26) on said carriage for guiding the carriage along said rails, and driving chains (28, 29) located at two opposite sides of the carriage and operative for lifting and lowering the carriage in a step-wise manner.

7. The apparatus as defined in claim 6, wherein said upright rails have lower ends which are joined together by horizontal girders rigidly connected to said frame.

8. The apparatus as defined in claim 7, wherein said gripper means include two turning hooks.

* * * * *